US006168060B1

(12) United States Patent
Mayers

(10) Patent No.: US 6,168,060 B1
(45) Date of Patent: Jan. 2, 2001

(54) NESTED, TWO-LAYER GOLF BAG STRAP FOR ONE-SHOULDER OR TWO-SHOULDER CARRYING

(76) Inventor: Edward Mayers, 6134 Paseo Delicias, Rancho Santa Fe, CA (US) 92067

( * ) Notice: Under 35 U.S.C. 154(b), the term of this patent shall be extended for 0 days.

(21) Appl. No.: 09/394,855

(22) Filed: Sep. 13, 1999

Related U.S. Application Data

(60) Provisional application No. 60/100,592, filed on Sep. 16, 1998.

(51) Int. Cl.[7] ..... A45F 3/04; A45F 3/14

(52) U.S. Cl. ..... 224/645; 224/257; 224/579; 224/627

(58) Field of Search ..... 224/257, 258, 224/153, 578, 579, 580, 581, 627, 645, 150, 264

(56) References Cited

U.S. PATENT DOCUMENTS

| | | | | |
|---|---|---|---|---|
| D. 362,752 | * | 10/1995 | Steurer | 224/645 |
| 4,153,092 | * | 5/1979 | Haslam | 224/579 X |
| 4,291,822 | * | 9/1981 | Simonds | 224/257 |
| 4,768,689 | * | 9/1988 | Davis | 224/150 X |
| 4,817,835 | * | 4/1989 | Tarr, Jr. | 224/150 |
| 4,856,570 | * | 8/1989 | Rushing et al. | 224/153 X |
| 4,911,347 | * | 3/1990 | Wilhite | 224/627 X |
| 4,942,995 | * | 7/1990 | Myers | 224/257 X |
| 5,282,558 | * | 2/1994 | Martinez | 224/627 X |
| 5,499,761 | * | 3/1996 | Reimers | 224/257 X |
| 5,566,871 | * | 10/1996 | Weintraub | 224/264 |
| 5,954,255 | * | 9/1999 | Beebe et al. | 224/645 |
| 5,979,727 | * | 11/1999 | Steurer | 224/627 X |

* cited by examiner

*Primary Examiner*—Gregory M. Vidovich
(74) *Attorney, Agent, or Firm*—Leonard Tachner

(57) ABSTRACT

A bag strap functions as a one-shoulder carrier or a two-shoulder carrier at any time according to the desire of the golfer. Reconfiguring the strap to convert from a one-shoulder type to a two-shoulder type, or visa versa, is easy and quick and can be accomplished even during a round of golf. The strap comprises two nested layers. When the two layers are secured together by a VELCRO hook and loop fastener and secured to upper and lower back rings by hooks, the strap functions as a one-shoulder strap. The nested configuration permits a comfortable, padded one-shoulder strap that is still reasonably thin and not unduly heavy and thick. Alternatively, strap layers may be separated from each other and the lower ring used as a slip through ring for an elongated belt secured by a slide-release buckle for encircling the golfer. Each layer is worn over a respective shoulder with the bag carried diagonally across the golfer's back.

3 Claims, 3 Drawing Sheets

NESTED, TWO-LAYER GOLF BAG STRAP FOR ONE-SHOULDER OR TWO-SHOULDER CARRYING

CROSS-REFERENCE TO RELATED APPLICATIONS

This application takes priority from a provisional application, Ser. No. 60/100,592 filed on Sep. 16, 1998.

BACKGROUND OF THE INVENTION

1. Field of the Invention

The present invention relates generally to the field of golfing equipment and more particularly to a golf bag strap that enables both one-shoulder and two-shoulder carrying according to a golfer's preference.

2. Background Art

Historically, those who walk the length of a golf course carrying a golf bag have used a strap for one-shoulder carrying. More recently, a variety of straps for two-shoulder golf bag carrying have been marketed. Unfortunately, a two-shoulder type strap is not conveniently usable as a one-shoulder carrier and a one-shoulder type strap is not usable as a two-shoulder carrier. Therefore, unless one purchases two separate straps, a decision to use one or the other type strap essentially precludes the second type of carrier. Moreover, unless one carries an extra strap during a round of golf, once a decision to use a particular strap is made, that round of golf must be completed with the selected type of carrier, i.e., one-shoulder or two-shoulder. Thus, despite the desire or need on the part of the golf to alter the method of carrying a golf bag, there is no current way of doing so short of purchasing and carrying two different types of golf bag straps.

SUMMARY OF THE INVENTION

The bag strap of the present invention provides a unique capability to function as a one-shoulder carrier or a two-shoulder carrier at any time according to the desire of the golfer. Reconfiguring the strap to convert from a one-shoulder type to a two-shoulder type, or visa versa, is easy and quick and can be accomplished even during a round of golf. The invention comprises a two-layer nested strap. When the two layers are secured together by a VELCRO tie and secured to upper and lower bag rings by snap hooks, the strap functions as a one-shoulder strap. The nested configuration permits a comfortable, padded one-shoulder strap that is still reasonably thin and not unduly heavy and thick.

Alternatively, the strap layers may be separated from each other and the lower ring used as a slip through ring for an elongated belt secured by a buckle for encircling the golfer. Each layer is worn over a respective shoulder with the bag carried diagonally across the golfer's back.

OBJECTS OF THE INVENTION

It is therefore a principal object of the present invention to provide a golf bag strap which may be configured in two distinct ways for carrying a golf bag either over one shoulder or over two shoulders.

It is another object of the invention to provide a golf bag strap having two layers which may be separated for two-shoulder bag carrying or nested together for one-shoulder bag carrying.

It is yet another object of the invention to provide a golf bag strap which can be readily reconfigured during a round of golf to convert from a one-shoulder bag carrier to a two-shoulder bag carrier or visa versa.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
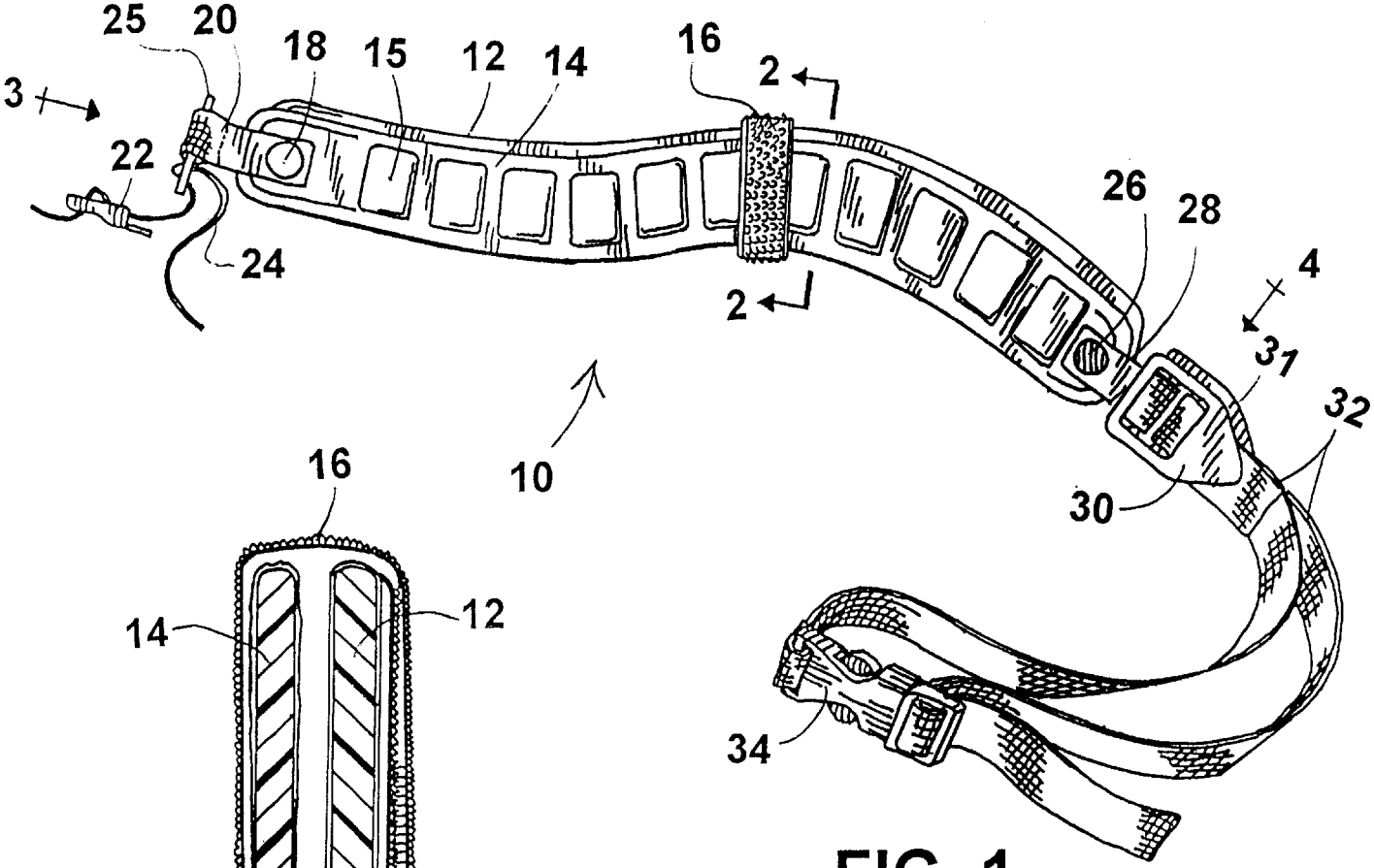
FIG. 1 is a three-dimensional view of the golf bag strap of the invention shown in a one-shoulder bag carrying configuration.
Figure 2:
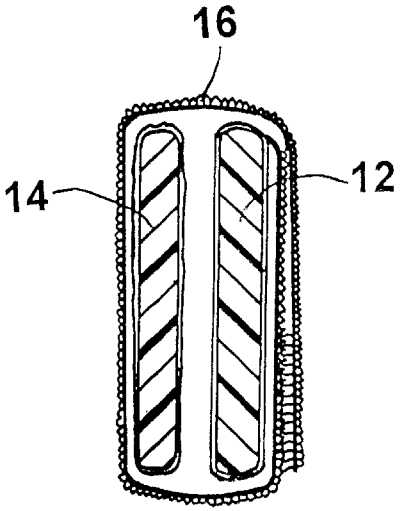
FIG. 2 is a cross-section view taken along lines 2—2 of FIG. 1.
Figure 4:
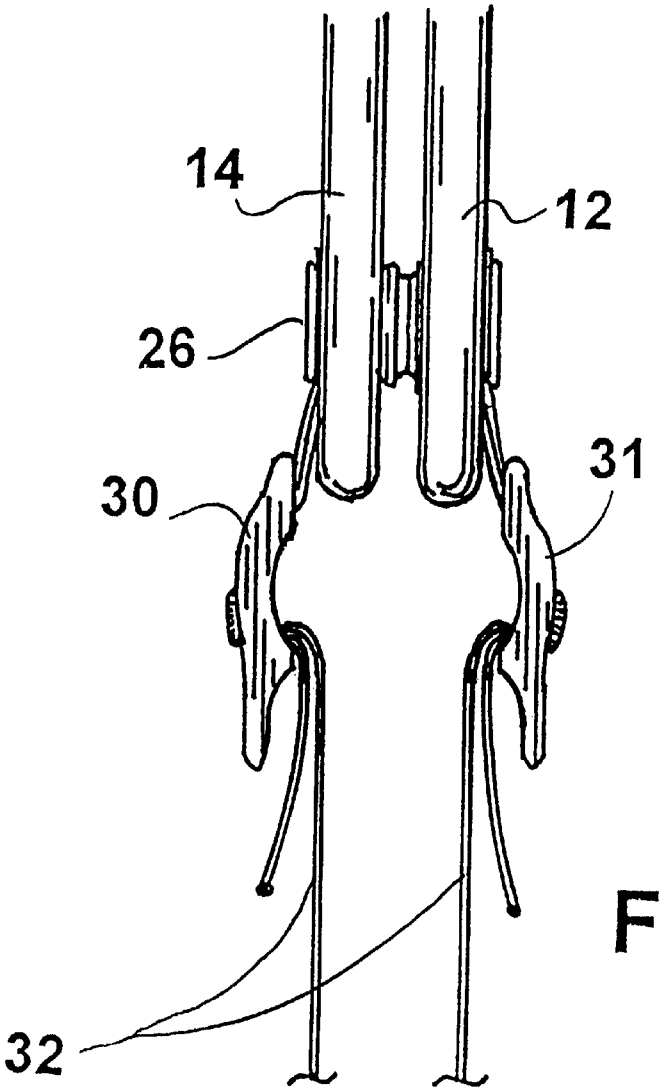
FIGS. 3 and 4 illustrate respective strap end interfaces with snap hooks.
Figure 3:
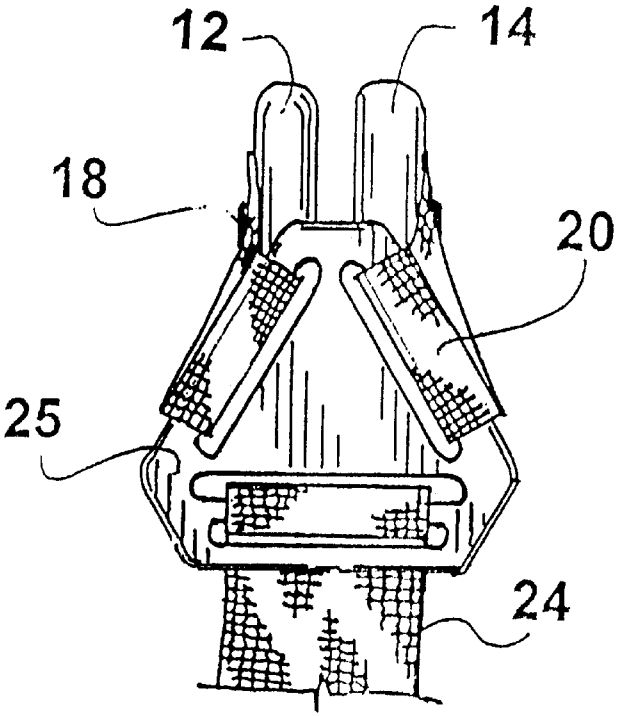

The present invention comprises a two-layer nested strap for carrying golf bags as illustrated in the accompanying drawings of FIGS. 1–5. The two-layer nested strap can be used as a conventional singular strap secured between attachment points above and below the handle of the golf bag (such as by the connecting snap hooks of FIGS. 3 and 4) to permit over-the-shoulder carrying of the bag. In this singular configuration, a VELCRO loop holds the two layers together as shown in FIGS. 1 and 2. Alternatively, the strap layers may be separated from each other and used in the manner shown in FIG. 5 whereby each layer is secured over a respective shoulder. In this manner, the golf bag may be carried behind the golfer with golf bag weight distributed over both shoulders simultaneously. When the two layers of the strap are nested together as seen best in FIG. 1, the strap is not overly thick because the nesting arrangement permits depressions on one layer to receive like-shaped rises on the other layer.

The golf bag strap 10 comprises a first layer 12 and a second layer 14. Each such layer has offset nesting undulations 15. The two layers may be secured to one another in nested engagement by a tie 16 which in the preferred embodiment is a VELCRO band which has a self-adhering tip.

One end of the strap 10 has a releasable snap 18 securing the two layers 12 and 14 together and anchoring a pair of bands 20. Bands 20 are secured to a coupler 25 to which there are connected a belt 24 and a buckle 22. Another end of strap 10 has a snap 26 releasably securing the two layers 12 and 14 together and anchoring a pair of bands 28. Bands 28 are respectively secured to a pair of buckles 30 and 31 to which there are connected an elongated belt 32 having a two-piece slide release buckle 34.

Figure 5:
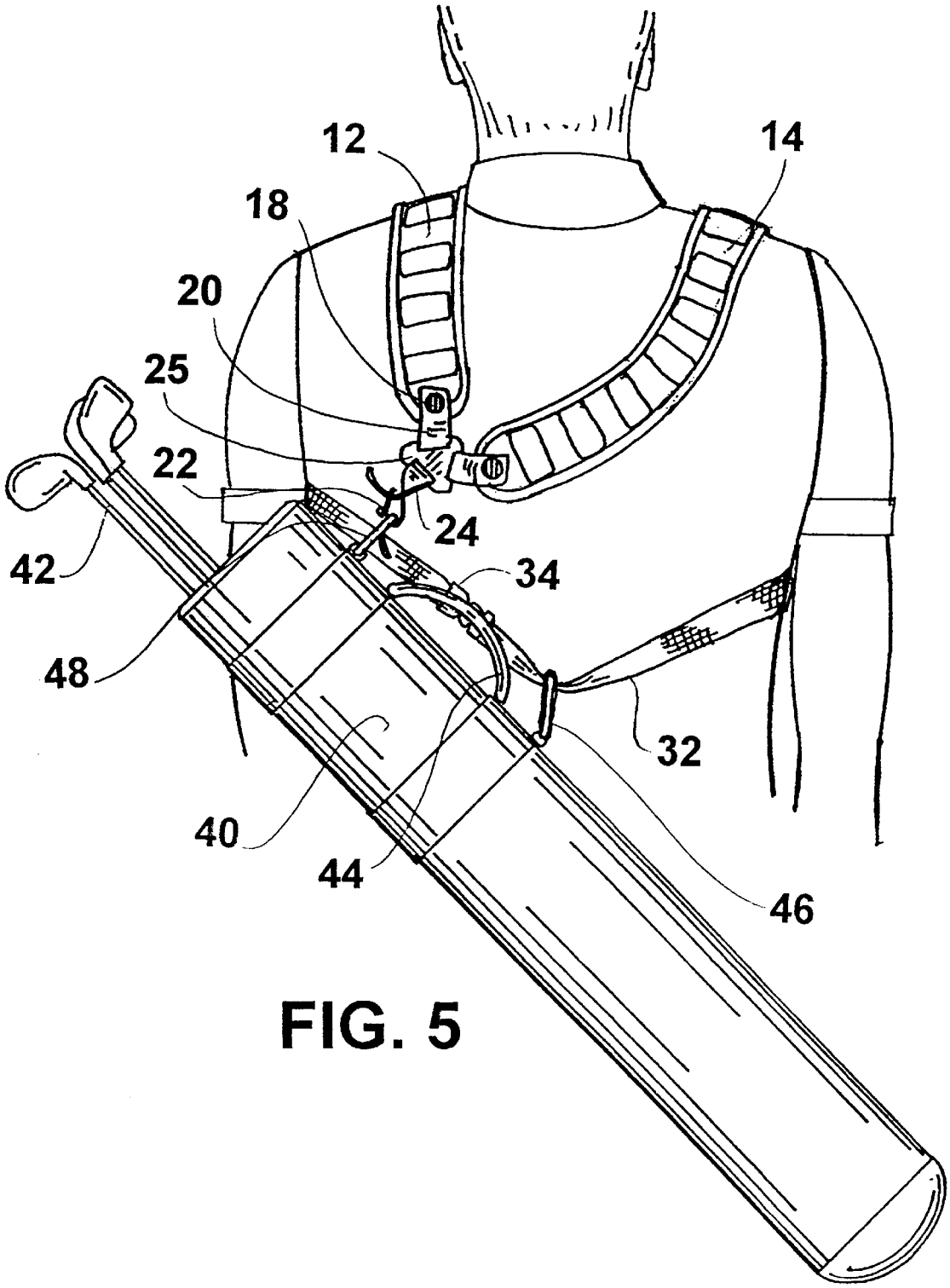
FIG. 5 is a rear view of a golfer shown carrying a golf bag using the strap hereof in its two-shoulder bag carrying configuration.

When connected in the manner shown in FIG. 5, the strap 10 acts as a two-shoulder carrier for a bag 40, holding a plurality of clubs 42. Bag 40 has a handle 44 and a lower ring 46 and an upper ring 48. Both snaps 18 and 26 are opened to separate the layers 12 and 14. Buckle 22 is used to connect belt 24 to upper ring 46 and buckle 34 is used to feed belt 32 through lower ring 46 in a threaded slidable configuration. When configured as shown in FIG. 1, strap 10 comprises nested layers 12 and 14 which may be connected between rings 46 and 48 with belt 32 and snap hook 34 adjusted to provide desired length for one-shoulder operation.

It will now be apparent that the disclosed embodiment satisfies the aforementioned objects. Moreover, it will now be understood that numerous alternative embodiments are feasible based upon the nested two-layer strap disclosed herein. Accordingly, variations and additions which may be made to the invention are contemplated to be within the scope hereof which is limited only by the claims appended hereto.

I claim:

1. A golf bag strap comprising:

a pair of substantially congruent, elongated strap layers releasably interconnected at their respective ends and in overlying relation forming a singular strap for one-shoulder bag carrying and upon release of said respective ends forming a pair of straps for two-shoulder bag carrying;

wherein each such layer comprises a series of undulations for nesting one layer on the other, the undulations of the respective layers being offset such that an undulation on one layer is received between adjacent undulations on the other layer.

2. The golf bag strap recited in claim 1 further comprising a tie connected to at least one of said strap layers between said respective ends for securing said layers to one another for one-shoulder bag carrying.

3. The golf bag strap recited in claim 1 further comprising means for connecting said golf bag strap to a golf bag at two spaced apart locations.

* * * * *